US012214916B2

(12) United States Patent
Schwandt et al.

(10) Patent No.: US 12,214,916 B2
(45) Date of Patent: Feb. 4, 2025

(54) MACHINE ARRANGEMENT AND METHOD FOR FILLING AND SEALING CONTAINERS

(71) Applicant: Syntegon Technology GmbH, Waiblingen (DE)

(72) Inventors: Matthias Schwandt, Wallhausen (DE); Steffen Haefelein, Crailsheim (DE); Bjoern Krause, Crailsheim (DE); Christopher Klemm, Aurach (DE); Andreas Kuba, Crailsheim (DE); Sebastian Gran, Frankfurt am Main (DE)

(73) Assignee: Syntegon Technology GmbH, Waiblingen (DE)

( * ) Notice: Subject to any disclaimer, the term of this patent is extended or adjusted under 35 U.S.C. 154(b) by 236 days.

(21) Appl. No.: 17/612,101

(22) PCT Filed: Mar. 31, 2020

(86) PCT No.: PCT/EP2020/059117
§ 371 (c)(1),
(2) Date: Nov. 17, 2021

(87) PCT Pub. No.: WO2020/233881
PCT Pub. Date: Nov. 26, 2020

(65) Prior Publication Data

US 2022/0212818 A1 Jul. 7, 2022

(30) Foreign Application Priority Data

May 18, 2019 (DE) ..... 10 2019 207 282.8

(51) Int. Cl.
*B65B 3/00* (2006.01)
*B65B 7/28* (2006.01)
*B65B 65/00* (2006.01)

(52) U.S. Cl.
CPC ..... *B65B 3/003* (2013.01); *B65B 7/28* (2013.01); *B65B 65/006* (2013.01)

(58) Field of Classification Search
CPC .. B65B 3/00; B65B 3/003; B65B 3/02; B65B 7/161; B65B 7/28; B65B 7/2821;
(Continued)

(56) References Cited

U.S. PATENT DOCUMENTS 10,829,252 B2 11/2020 Trilli et al.
2003/0056466 A1* 3/2003 Muneyasu ..... B65B 3/003 141/171

(Continued)

FOREIGN PATENT DOCUMENTS

CN 203094481 U 7/2013
CN 107735321 A 2/2018

(Continued)

OTHER PUBLICATIONS

Chinese Patent Office Action for Related Application No. 202080036797.4 dated Sep. 30, 2022 (15 pages, Including an English translation).

(Continued)

*Primary Examiner* — Stephen F. Gerrity
(74) *Attorney, Agent, or Firm* — Michael Best & Friedrich LLP

(57) ABSTRACT

The present invention relates to a machine arrangement, in particular for processing pharmaceutical products, comprising a processing station (2) for filling and sealing containers, in particular with pharmaceutical products, a handling device (3) for feeding and removing the containers into the machine arrangement, wherein the handling device (3) is designed to feed and remove containers only from exactly one side of the machine arrangement into the machine arrangement, wherein the processing station (2) has at least (Continued)

one work region (4) for receiving an empty container, at which the empty container is filled and sealed, wherein the processing station (2) has at least one storage region (5) for the temporary storage of filled and sealed containers, and wherein the handling device (3) is designed to feed empty containers to the processing station (2) and remove filled and sealed containers from the storage region (5).

16 Claims, 4 Drawing Sheets

(58) Field of Classification Search
CPC ..... B65B 43/42; B65B 43/46; B65B 55/027; B65B 65/003; B67C 7/0033
USPC ..... 53/281, 283, 284.6
See application file for complete search history.

(56) References Cited

U.S. PATENT DOCUMENTS

| | | | | |
|---|---|---|---|---|
| 2009/0223592 | A1* | 9/2009 | Procyshyn et al. | B65B 3/003 141/2 |
| 2012/0090268 | A1* | 4/2012 | Krauss | B65B 3/003 53/281 |
| 2015/0107190 | A1* | 4/2015 | Zambaux | B65B 55/027 53/287 |
| 2016/0200461 | A1* | 7/2016 | Broadbent et al. | B65B 3/003 53/426 |
| 2018/0009553 | A1* | 1/2018 | Froehlich et al. | B65B 65/003 |
| 2018/0072446 | A1* | 3/2018 | Naing | B65B 55/027 |
| 2018/0229866 | A1* | 8/2018 | Eberhardt et al. | B65B 3/003 |
| 2021/0221541 | A1 | 7/2021 | Strauss | |

FOREIGN PATENT DOCUMENTS

| | | | | |
|---|---|---|---|---|
| CN | 109311542 | A | 2/2019 | |
| DE | 10330700 | A1 | 1/2005 | |
| DE | 102006039120 | A1 | 3/2008 | |
| DE | 102008001287 | A1 | 10/2009 | |
| DE | 102009027452 | A1 | 1/2011 | |
| DE | 102013211526 | A1 | 12/2014 | |
| DE | 102017100010 | A1 | 7/2018 | |
| EP | 2280873 | | 2/2011 | |
| EP | 2420450 | A1 * | 2/2012 | B65B 3/003 |
| EP | 2280873 | B1 | 10/2012 | |
| WO | 2009130112 | A1 | 10/2009 | |
| WO | 2011000606 | A1 | 1/2011 | |

OTHER PUBLICATIONS

International Preliminary Report on Patentability for Application No. PCT/EP2020/059117 dated Dec. 2, 2021 (6 pages).
Translation of International Search Report for Application No. PCT/EP2020/059117 dated May 27, 2020 (2 pages).
Canadian Patent Office Action for Application No. 3136505 dated Feb. 2, 2024 (5 pages).

* cited by examiner

MACHINE ARRANGEMENT AND METHOD FOR FILLING AND SEALING CONTAINERS

BACKGROUND

The present invention relates to a machine arrangement and a method for filling and sealing containers, in particular pharmaceutical containers such as vials, syringes or small bottles or the like.

Machine arrangements for filling and sealing containers are known from the prior art in different designs. In the pharmaceutical sector, there is a clear trend toward small-batch filling, since new or personalized oncology or auto-immune therapies require an individual combination of pharmaceutical products. Existing machine concepts for filling and sealing containers are usually based on a series arrangement in which the container passes through multiple processing stations in a row, with transport or handling steps being necessary between the individual stations. Such a machine arrangement is known from EP 2280873 B1, for example. Such machine arrangements are, however, rather unsuitable for use in small batches, since the known machine arrangements are designed for large throughput quantities.

SUMMARY

The machine arrangement according to the invention has the advantage that a very compact and inexpensive design is possible. In particular, the space taken up by the machine arrangement is significantly reduced compared to the prior art. Furthermore, the cycle times for filling and sealing the containers can be significantly reduced compared to the prior art. In particular, empty runs of handling devices are minimized or completely eliminated. Furthermore, the machine arrangement according to the invention has increased flexibility and can handle individually fed containers or can also handle containers which are to be removed in a format template, for example a tray or the like, in particular without conversion measures. This is achieved according to the invention in that the machine arrangement has a processing station for filling and sealing containers and a handling device for loading and unloading the containers into and out of the machine arrangement. The handling device is designed to feed and remove containers from one side of the machine arrangement into it. This significantly reduces a so-called footprint of the machine compared to the continuous-flow machines used so far. The processing station has at least one work region for receiving a container, at which the container is filled and sealed. The processing station also has a storage region in which the filled and sealed container is temporarily stored. The handling device is designed to feed empty containers to the processing station and remove filled and sealed containers from the storage region. Since the handling device is designed to feed and remove the containers from one side of the machine arrangement, significantly reduced cycle times can be achieved and empty runs can be avoided, and format parts and space requirements, in particular a footprint, can be optimized.

The examples disclosed herein illustrate, in some instances, preferred developments of the invention.

Particularly preferably, the processing station further comprises a weighing station for weighing empty and/or filled containers. The weighing station is preferably arranged directly at the filling station, so that the weighing process can be carried out even during the filling process.

The processing station further preferably comprises an inspection device for checking the condition of the empty and/or filled containers. The inspection device is preferably a visual inspection device, for example camera-based.

Further preferably, the machine arrangement comprises a format receptacle with multiple receiving spaces for individual containers. In this case, four receiving spaces are preferably provided in the format receptacle. It is particularly preferable to have two receiving spaces for empty containers that are being filled and sealed and two receiving spaces for containers that are already filled and sealed.

More preferably, a number of processing spaces in the processing station is half as large as a number of receiving spaces in the format receptacle. This means that, if there are a total of four receiving spaces in the format receptacle, the processing station has exactly two work spaces.

More preferably, the holding device also has a plurality of individually controllable grippers, the number of grippers being equal to the number of processing spaces and/or the number of object positions in the processing station. In this way, individual control of grippers and thus handling of individual containers can be implemented.

The handling device is preferably a robot arm or, alternatively, a transport carriage. One or more manipulator towers are preferably provided on the transport carriage. The manipulator towers can also be arranged so as to be rotatable, in particular rotatable by 90°.

In order to achieve simple forward and backward transport in the machine arrangement, a turning station with at least two, preferably at least four, receiving spaces for containers is preferably provided, with one of the receiving spaces forming the storage region for the temporary storage of filled and sealed containers. The turning station is preferably designed to receive the entire format receptacle with multiple receiving spaces and turn it through 180°.

More preferably, the machine arrangement comprises a closed housing having a first lock. The empty containers are fed into the housing via the first lock and the filled and sealed containers are removed via the first lock. Such a machine arrangement is used in particular in the pharmaceutical sector. If necessary, the interior of the housing can be made sterile.

Further preferably, the machine arrangement comprises a second lock, with empty containers being fed into the housing via the second lock and the filled and sealed containers being removed via the second lock. This means that containers can be fed into and removed from the housing from two sides.

Particularly preferably, the machine arrangement further comprises a control device which is designed to be operated in one of three operating modes depending on a type of container and/or a type of feed. A first operating mode is designed in such a way that empty containers are introduced into the housing of the machine arrangement through the first lock and filled and sealed containers are discharged from the machine arrangement through the first lock. A second operating mode is designed in such a way that empty containers are introduced into the housing of the machine arrangement through this second lock and filled and sealed containers are discharged again from the machine arrangement through the second lock. A third operating mode is further designed such that empty containers are fed into the housing of the machine arrangement through one of the two locks and filled and sealed containers are discharged from the machine arrangement through the other of the two locks. Thus, according to the invention, three different operating modes can be provided in which containers are fed and removed exclusively from a single side or in which containers are guided through the machine arrangement using the continuous flow principle.

Particularly preferably, the machine arrangement comprises a first and a second additional module, the first additional module being arranged at the first lock and the second additional module being arranged at the second lock. The first additional module is designed to handle format receptacles for receiving a plurality of containers. The second additional module is designed to handle only isolated containers. This makes it possible, for example, for containers in a format receptacle, e.g. a tray, with a large number of openings for receiving a large number of containers to be processed via the first additional module and for individual or isolated containers to be processed further by the machine arrangement via the second additional module. Thus, with a single machine arrangement, it is possible to process both larger batches and small batches by feeding them through the respective different additional modules. Up to now, in the prior art, multiple machine arrangements were always necessary for this, and each of the multiple machine arrangements could only either process containers from format receptacles or isolated containers.

The containers are preferably vials, syringes, cartridges, small containers, special containers or the like.

The present invention also relates to a method for filling and sealing containers, in particular pharmaceutical containers, in a processing station, which can be carried out in one of three operating modes. A first operating mode is designed in such a way that containers are introduced into the housing of the machine arrangement through the first lock and filled and sealed containers are discharged again from the machine arrangement through the first lock.

A second operating mode is designed such that containers are introduced into the housing of the machine arrangement through the second lock and filled and sealed containers are discharged again from the machine arrangement through this second lock.

A third operating mode is designed such that empty containers are introduced into the housing of the machine arrangement through the first lock and filled and sealed containers are discharged again from the housing of machine arrangement through the second lock. This allows the continuous flow principle to be implemented on the machine arrangement.

In the first and second operating modes, a circulation principle is applied within the housing of the machine arrangement so that the containers are discharged back through the lock through which they were introduced into the housing.

With regard to the term "lock," it should be noted that, according to the invention, this is understood to mean both locks for cleanroom applications in which undesired contamination of the cleanroom inside the housing of the machine arrangement is to be avoided, as well as in particular sealable openings in housings through which containers can be introduced into the housing and removed again from the housing.

More preferably, the method comprises the step of arranging the filled and sealed container on a storage region of the processing station, from which the filled and sealed container is then removed.

BRIEF DESCRIPTION OF THE DRAWINGS

Preferred embodiments of the invention are described in detail below with reference to the accompanying drawing. In the drawing is.

DETAILED DESCRIPTION

A machine arrangement 1 according to a first preferred embodiment of the invention is described in detail below with reference to FIGS. 1 and 2.

Figure 1:
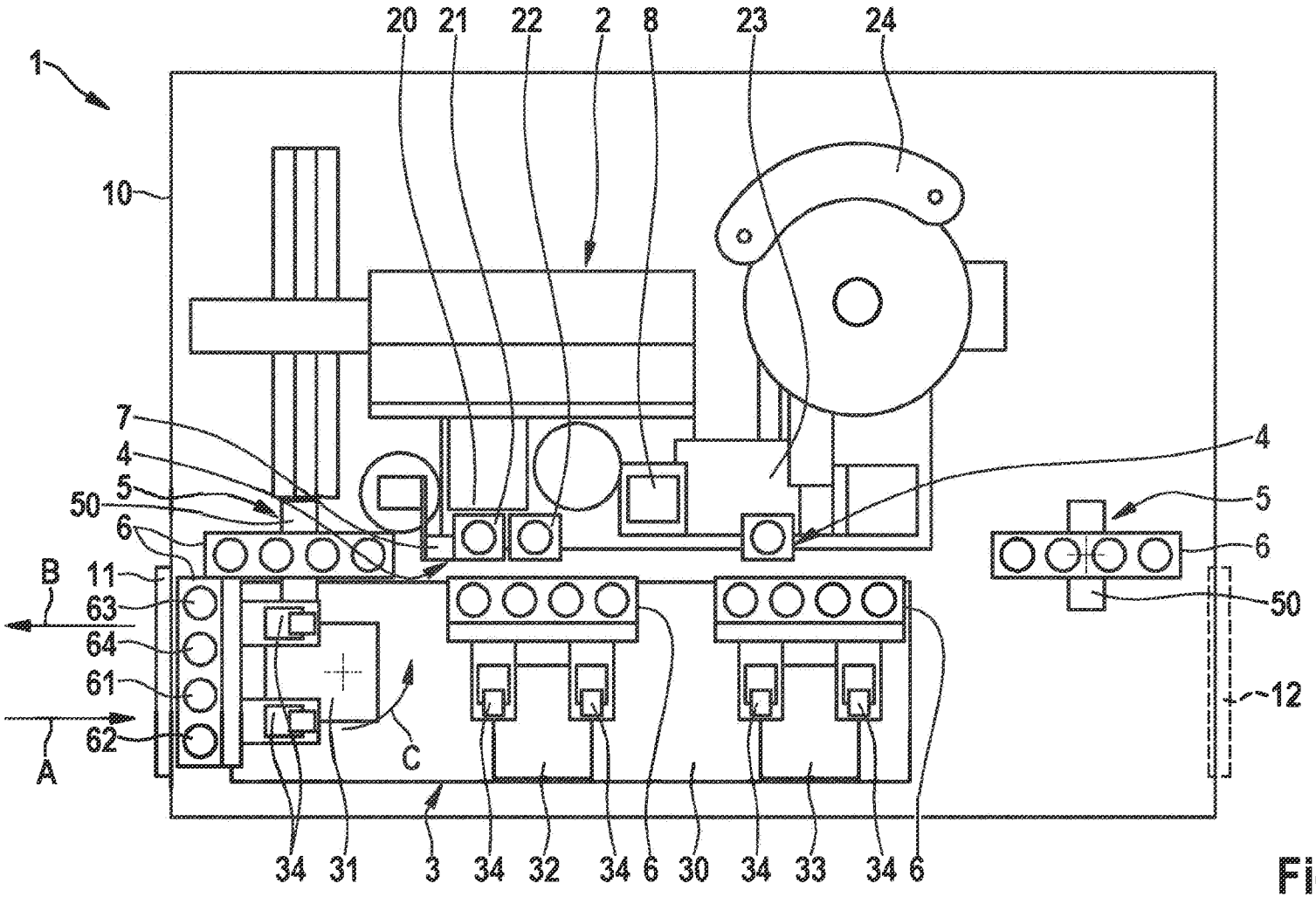
FIG. 1 a schematic illustration of a machine arrangement according to a first preferred embodiment of the invention in a first state, FIG. 2 a schematic illustration of the machine arrangement from FIG. 1 in a second state, FIG. 3 a schematic illustration of a machine arrangement according to a second embodiment of the invention, and FIG. 4 a schematic illustration of a machine arrangement according to a third embodiment of the invention.

As can be seen from FIG. 1, the machine arrangement 1 comprises a processing station 2 and a handling device 3.

The machine arrangement 1 further comprises a closed housing 10 with four sides, with a first lock 11 being arranged on one side. As indicated by the arrows A and B in FIG. 1, the containers are fed and removed only via the first lock 11.

The processing station 2 comprises a filling station 20 and a sealing station 23. Depending on the type of container, a corresponding seal is applied to the container in the sealing station 23 and the container is thus sealed.

The machine arrangement 1 further comprises a work space region 4 which is arranged directly in front of the filling station 20 and the sealing station 23.

The sealing station 23 comprises an oscillating conveyor 24 which feeds the sealing bodies, for example stoppers or the like, to the filled container so that they can be sealed in the sealing station 23.

The machine arrangement 1 further comprises a storage region 5 for the temporary storage of filled and sealed containers. These filled and sealed containers are then removed from the housing 10 of the machine arrangement 1 from the storage region 5 via the first lock 11.

The processing station 2 further comprises a weighing station 7 which is arranged at the filling station 20. An inspection station 8 is also provided. The inspection station 8 in this embodiment is a visual inspection station. It should be noted, however, that additional inspection devices may be provided, for example for the seal, damage to the container, residual oxygen content in the container after filling, fill level inspection and/or an inspection of a residual air bubble in the closed container.

As can be seen in detail from FIG. 1, a first processing space 21 and a second processing space 22 are provided in front of the filling station 20. Each of the two processing spaces 21, 22 is designed to receive an empty container. These empty containers are then filled at the first and second processing space. The filled containers are then transported to the sealing station 23.

Figure 2:
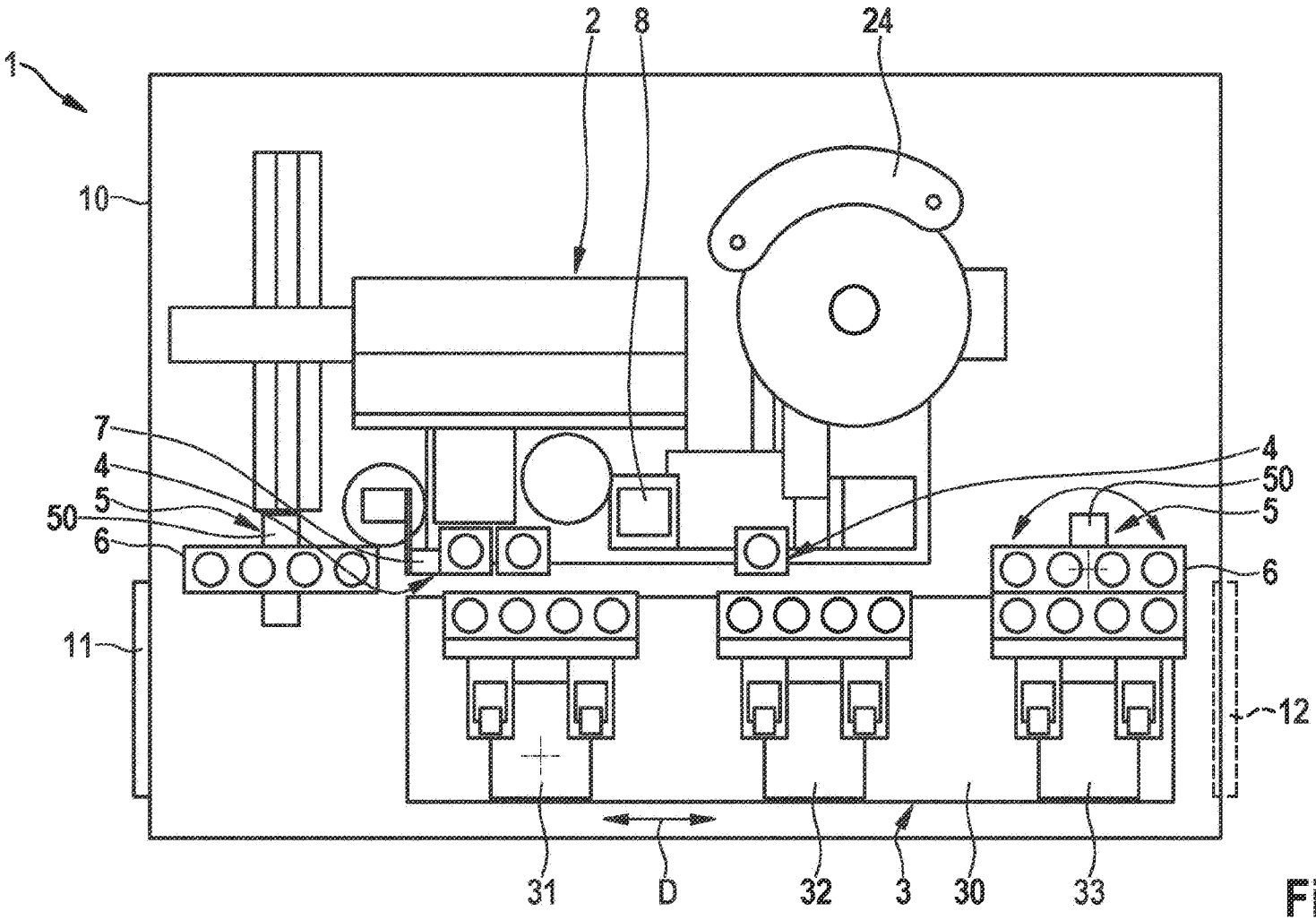

As can be seen from FIGS. 1 and 2, the handling device 3 in the machine arrangement 1 comprises a carriage 30. Three manipulator towers 31, 32 and 33 are arranged on the carriage 30. The three manipulator towers 31, 32, 33 have a fixed position on the carriage 30. However, the first and the third manipulator tower 31, 33 can be rotated through 90° (cf. in particular the positions of the manipulator tower 31 in FIGS. 1 and 2), as indicated in FIG. 1 by the arrow C.

Each of the manipulator towers 31, 32, 33 has two individually controllable grippers 34. The grippers 34 can remove containers from the format receptacle 6 and return filled and/or sealed containers back into the format receptacle 6, for example.

The first manipulator tower 31 can also remove containers from the machine arrangement 1 via the first lock 11 and feed empty, new containers into the machine arrangement 1 via the first lock 11.

The format receptacle 6 has four receiving spaces, namely a first receiving space 61, a second receiving space 62, a third receiving space 63 and a fourth receiving space 64. The two first receiving spaces 61, 62 are provided for feeding the containers to the processing station and the two third and fourth receiving spaces 63, 64 are provided for removing the filled and sealed containers from the machine arrangement 1.

The machine arrangement 1 also comprises a turning station 50. As can be seen from FIG. 1, the turning station 50 is arranged in the storage region 5 in the machine arrangement 1. The turning station 50 makes it possible to turn through 180°. As a result, a position of the receiving spaces of the format receptacle 6 is reversed when it is located on the storage region 5 and is turned. As a result, the respective manipulator towers 31, 32, 33 can then transport the filled and sealed containers to the first lock 11 and discharge them from the machine arrangement 1.

By providing at least two different receiving spaces on the format receptacle 6, namely at least one space for an empty container to be filled and sealed and one space for a filled and sealed container, it is possible for the format receptacle to never be completely empty when passing through the machine arrangement 1. Either both empty containers and filled and sealed containers are arranged on the format receptacle 6 or only empty containers and empty spaces for filled and sealed containers to be received later are provided, or empty spaces for empty containers and occupied receiving spaces for filled and sealed containers are provided.

The machine arrangement 1 is particularly suitable for filling small batches of pharmaceutical products. Within the machine arrangement 1, the carriage 30 can be moved linearly in both directions, as indicated in FIG. 2 by the double arrow D. The first manipulator tower 31 moves back and forth between the first lock 11 and the filling station 20, the second manipulator tower 32 moves back and forth between the filling station 20 and the sealing station 23, and the third manipulator tower 33 moves back and forth between the sealing station 23 and the storage region 5. By turning through 180° at the turning station 50, the filled and sealed containers can be transported back from the third manipulator tower to the second manipulator tower and from the second manipulator tower to the first manipulator tower and from the first manipulator tower out of the machine arrangement 1.

It should be noted that the machine arrangement 1 can also have a second lock 12, which is shown in dashed lines in FIGS. 1 and 2. Containers could then also be fed and removed through the second lock.

Figure 3:
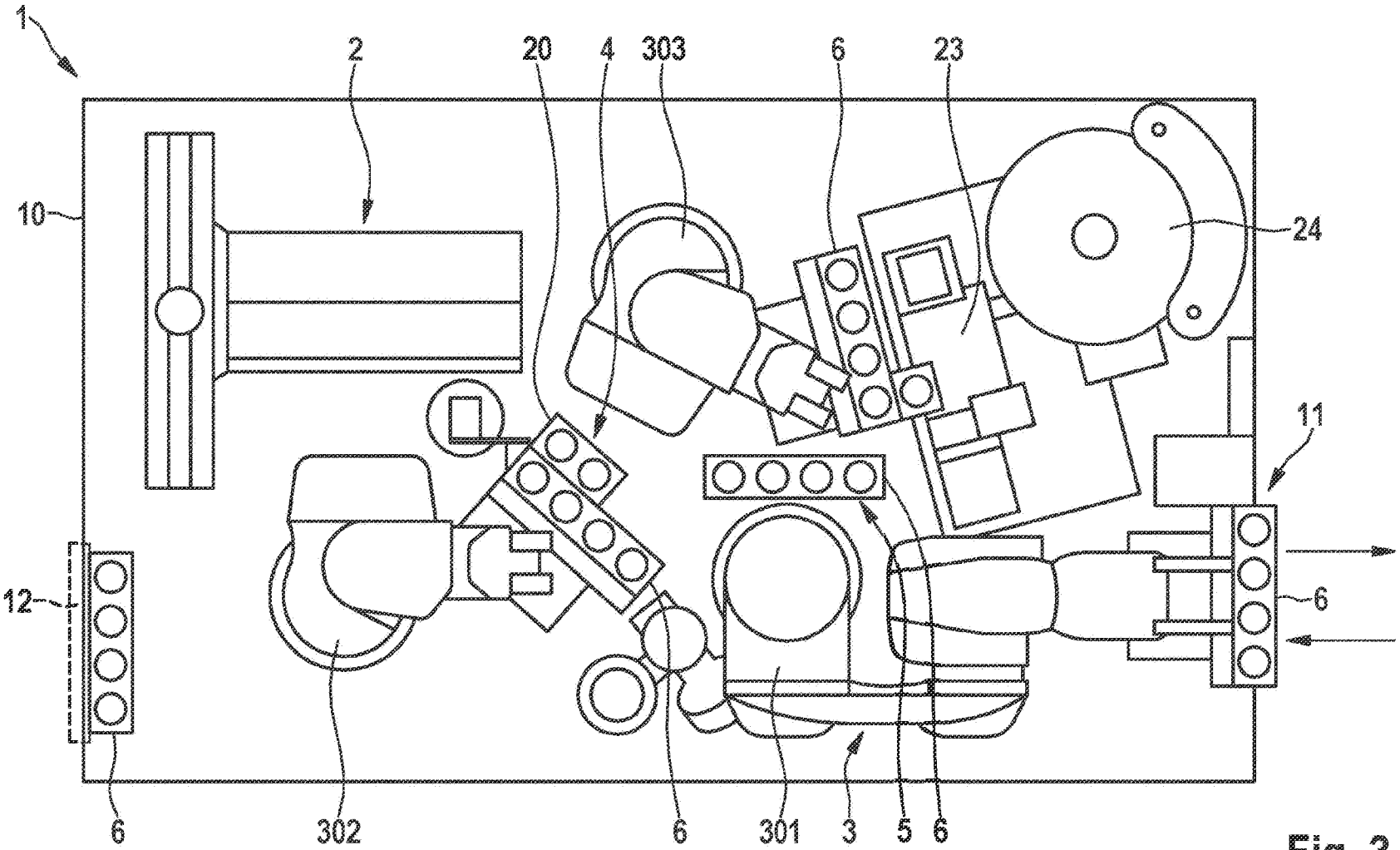

FIG. 3 shows a machine arrangement 1 according to a second embodiment of the invention. Identical or functionally identical parts are denoted by the same reference signs as in the first embodiment. In contrast with first embodiment, the machine arrangement 1 of the second embodiment has a different handling device 3. The handling device 3 of this embodiment comprises three robots 301, 302 and 303. Here, the first robot 301 is responsible for feeding the containers into the machine arrangement 1 and removing them from the machine arrangement 1 via the first lock 11. The second robot 302 takes over the format receptacle 6 from the first robot 301 and guides the empty containers to the filling station 20. The third robot 303 takes the then filled containers from the filling station 20 and transfers them to the sealing station 23, where they are sealed. The filled and sealed containers are then fed to the storage region 5 and temporarily stored there. The first robot 301 then takes the filled and sealed containers from the storage region 5 and discharges them via the first lock 11 on the same side of the machine arrangement 1 on which the containers were also introduced.

Otherwise, this embodiment corresponds to the previous embodiment, and so reference can be made to the description given there.

Figure 4:
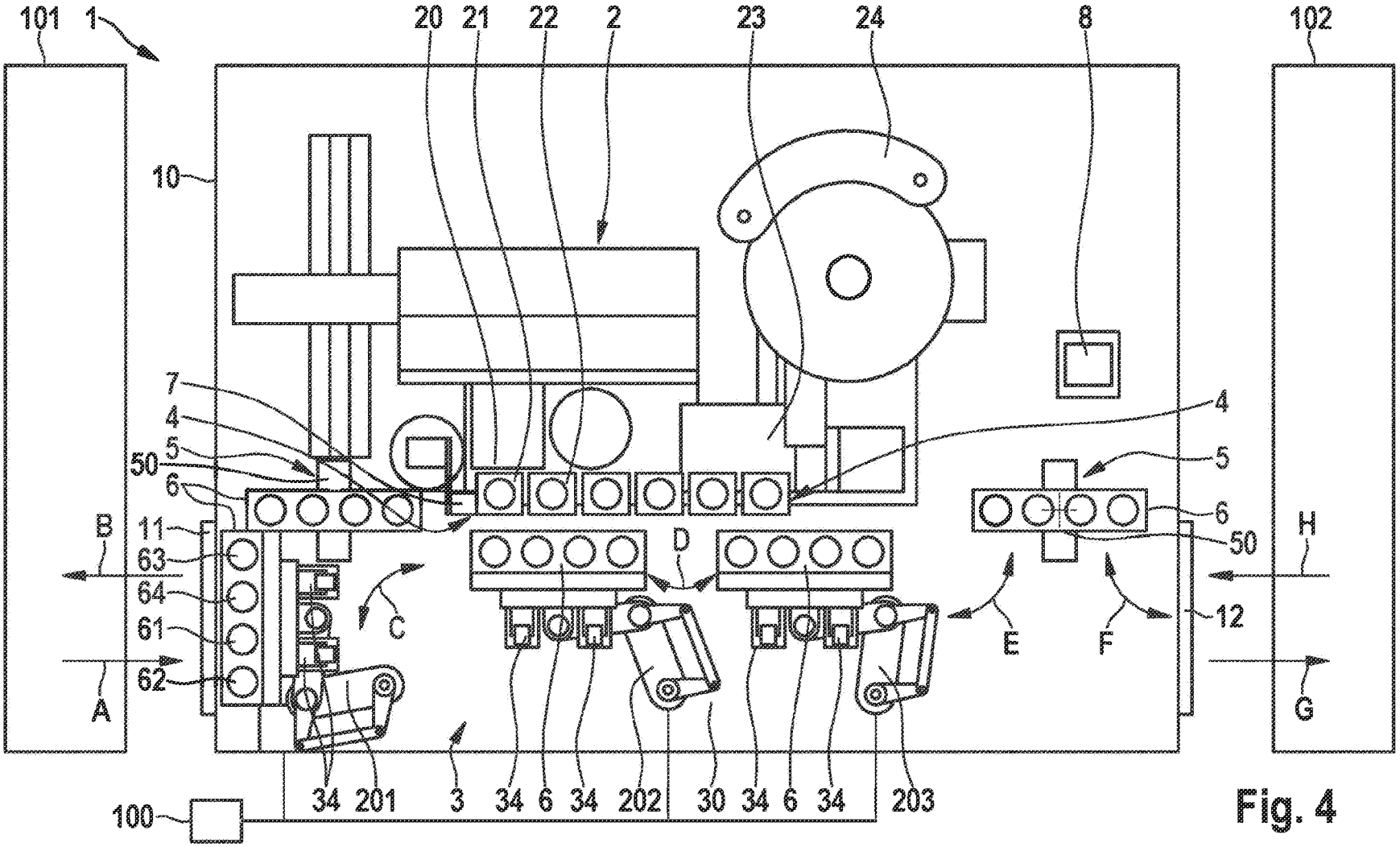

FIG. 4 shows a machine arrangement 1 according to a third embodiment of the present invention. Identical or functionally identical parts are denoted by the same reference signs.

In contrast with the previous embodiments, the machine arrangement 1 of the third embodiment comprises a handling device 3 with SCARA robots. As can be seen from FIG. 4, the handling device 3 comprises a total of three SCARA robots 201, 202 and 203. All three SCARA robots 201, 202, 203 have the same structure. The SCARA robots have a simpler structure than the robots shown in the second embodiment, with the SCARA robots 201, 202, 203 allowing handling substantially in a horizontal plane.

As can be seen from FIG. 4, the machine arrangement of the third embodiment comprises a first lock 11 and a second lock 12. The two locks are arranged opposite one another on the housing 10 of the machine arrangement. The machine arrangement 1 of the third embodiment further comprises a first additional module 101 and a second additional module 102. A control unit 100 is designed to control the three SCARA robots 201, 202, 203.

The first additional module 101 is arranged on the first lock 11. The first additional module is designed to handle format receptacles for receiving a plurality of containers. In this case, individual containers are removed from the format receptacle, which can be e.g. a tray or the like, and introduced into the interior of the housing 10 of the machine arrangement 1 via the first lock 11.

The second additional module 102 is designed to handle isolated containers. These can be containers which are separated by means of a star wheel or robot, for example.

The first additional module 101 is thus designed to handle a large number of containers. In contrast to this, the second additional module 102 is designed to handle only a small number of isolated containers.

The control unit 100 is designed to select one of three operating modes and to operate the machine arrangement accordingly. A first operating mode is designed in such a way that empty containers are introduced into the housing 10 of the machine arrangement through the first lock 11 and filled and sealed containers are discharged again from the machine arrangement through the first lock 11. As shown schematically in FIG. 4, the containers from the first additional module 101 are introduced into the interior of the housing 10 via the first lock 11 according to the arrow A and transported to the processing spaces 21, 22 by rotation through 90° according to the arrow C. After filling at the processing spaces 21, 22, the filled containers are conveyed further to the sealing station 23 (arrow D) and are sealed there. The sealed containers are then fed to the turning station 50 (arrow E) and turned there. Subsequently, a return transport takes place in accordance with the double arrows E, D and C for discharging again via the first lock 11 (arrow B) back to the first additional module 101. In the first additional module, the containers filled and sealed in this way can then be stored in a format receptacle with a large number of spaces. The second lock 12 is closed during the first operating mode.

A second operating mode of the control device 100 is designed in such a way that containers are introduced into the housing 10 of the machine arrangement 1 from the second additional module 102 via a second lock 12 in accordance with the arrow H. The empty containers are then fed via the third SCARA robot 203 and the second SCARA robot 202 to the processing spaces 21, 22 and filled there. The filled containers are then conveyed to the sealing station 23 (arrow D) and from there via the turning station 50 (arrow F) or alternatively or directly by means of the third SCARA robot 203 via the second lock 12 back to the second additional module 102 (arrow G). The first lock 11 is closed during the second operating mode.

A third operating mode of the control device 100 is a continuous flow mode, with empty containers being introduced into the housing 10 via the first lock 11, filled at the processing stations 21, 22, sealed at the sealing station 23 and transported out of the housing 10 via the second lock 12, and being further handled in the second additional module 102, for example in a corresponding further processing operation such as flanging, cleaning, inspecting, etc.

The provision of two locks 11, 12 thus allows three different operating modes to be carried out with a single machine arrangement 1. In the first operating mode, a large number of containers that are removed from a format receptacle are processed and returned to the format receptacle. In the second operating mode, only individual containers are fed from the additional module 102 into the processing station 2 and transported back to the second additional module. The second operating mode is particularly suitable for a small-batch application. In the third operating mode, a continuous flow mode can then be carried out by the machine arrangement 1, in which, for example, a large number of containers are arranged in a format receptacle and, after filling and sealing, individual containers are discharged via the second additional module 102.

This means that a high degree of variability can be achieved in the choice of containers to be filled, whereas, in the prior art, different machine arrangements have always been necessary.

In the third embodiment, small-scale SCARA robots are used, so that the investment costs in the machine arrangement shown are also relatively low. Thus, with the machine arrangement of the third embodiment, both a continuous flow mode and forward and backward transport and an introduction and discharge through the same lock can be realized. It should be noted that the continuous flow can of course also be provided starting from the second additional module 102 through the processing station 2 in the direction of the first additional module 101. Furthermore, the use of SCARA robots allows a reduction in automation complexity compared to universal robots as in the second embodiment.

What is claimed is:

1. A machine arrangement, comprising a processing station (2) for filling and sealing containers, a handling device (3) for feeding containers into and removing containers from the machine arrangement, wherein the handling device (3) is designed to feed containers into the machine arrangement and remove containers from the machine arrangement on a same side of the machine arrangement, wherein the processing station (2) has at least one work region (4) for receiving an empty container, at which the empty container is filled and sealed, wherein the processing station (2) has at least one storage region (5) for the temporary storage of filled and sealed containers, the at least one storage region (5) being located within the machine arrangement, wherein the at least one storage region (5) and the at least one working region (4) are arranged in separate and different positions, and wherein the handling device (3) is designed to feed empty containers to the processing station (2) and remove filled and sealed containers from the storage region (5).

2. The machine arrangement according to claim 1, wherein the processing station (2) comprises a weighing station (7) for weighing empty and/or filled containers.

3. The machine arrangement according to claim 1, wherein the processing station (2) comprises an inspection device for checking the condition of the empty containers and/or the filled containers.

4. The machine arrangement according to claim 1, further comprising a format receptacle (6) with multiple receiving spaces (61, 62, 63, 64) for individual containers.

5. The machine arrangement according to claim 4, wherein a number of processing spaces in the processing station (2) is half as large as a number of receiving spaces in the format receptacle (6).

6. The machine arrangement according to claim 5, wherein the handling device (3) has a plurality of individually controllable grippers (34), wherein the number of grippers (34) being equal to the number of processing spaces in the processing station (2).

7. The machine arrangement according to claim 1, wherein the handling device (3) comprises a carriage (30) and/or comprises a robot (301, 302, 303).

8. The machine arrangement according to claim 1, further comprising a turning station, wherein the turning station is arranged on the storage region (5).

9. The machine arrangement according to claim 1, further comprising a closed housing (10) having at least one first sealable opening (11) which is configured to permit feeding of empty containers into the housing (10) via the first sealable opening (11) and which is configured to permit removing filled and sealed containers via the first sealable opening (11).

10. The machine arrangement according to claim 9, further comprising a second sealable opening (12) which is configured to permit feeding of empty containers into the housing (10) via the second sealable opening (12) and which is configured to permit removing filled and sealed containers via the second sealable opening (12).

11. The machine arrangement according to claim 10, further comprising a control device (100) configured to be operated in one of three operating modes depending on a type of container and/or a type of feed, wherein a first operating mode is configured to introduce empty containers into the housing (10) of the machine arrangement through the first sealable opening (11) and to discharge filled and sealed containers from the housing of the machine arrangement through the first sealable opening (11), and wherein a second operating mode is configured to introduce empty containers into the housing (10) of the machine arrangement through the second sealable opening (12) and to discharge filled and sealed containers from the housing of the machine arrangement through the second sealable opening (12), and wherein a third operating mode is configured to introduce empty containers into the housing (10) of the machine arrangement through one of the sealable openings (11, 12) and to discharge filled and sealed containers from the housing of the machine arrangement through the other of the sealable openings (11, 12).

12. The machine arrangement according to claim 11, further comprising a first additional module (101) and a second additional module (102), wherein the first additional module (101) is arranged at the first sealable opening (11) and the second additional module (102) is arranged at the second sealable opening (12), wherein the first additional module (101) is configured to handle a format receptacle for receiving a plurality of containers and the second additional module (102) is configured to handle individual containers.

13. The machine arrangement according to claim 1, wherein the machine arrangement is for processing pharmaceutical products.

14. A method for filling and sealing containers in a processing station (2) using the machine arrangement claimed in claim 1, the method being able to be carried out in three operating modes including:

a first operating mode is configured to introduce the empty containers into a housing (10) of the machine arrangement through a first sealable opening (11) and to discharge the filled and sealed containers again from the housing of the machine arrangement through the first sealable opening (11), a second operating mode is configured to introduce the empty containers into the housing (10) of the machine arrangement through a second sealable opening (12) and to discharge the filled and sealed containers from the housing of the machine arrangement through the second sealable opening (12), and a third operating mode is configured to introduce the empty containers into the housing (10) of the machine arrangement through the first sealable opening (11) and to discharge the filled and sealed containers from the housing (10) of the machine arrangement through the second sealable opening (12).

15. The method according to claim 14, wherein, after filling and closing the container, the container is temporarily stored in the at least one storage region (5).

16. The method according to claim 14, wherein the containers are filled with pharmaceutical products.

* * * * *